United States Patent [19]

Zook

[11] 4,385,407

[45] May 31, 1983

[54] FLOATABLE POOL COVER

[76] Inventor: Kenneth W. Zook, 3339 Primera St., Hollywood, Calif. 90028

[21] Appl. No.: 275,589

[22] Filed: Jun. 19, 1981

[51] Int. Cl.[3] ..... E04H 3/16; E04H 3/18

[52] U.S. Cl. ..... 4/499; 4/498; 4/502

[58] Field of Search ..... 4/499, 502

[56] References Cited

U.S. PATENT DOCUMENTS

| | | | |
|---|---|---|---|
| 2,580,555 | 1/1952 | Kroeger | 4/502 |
| 3,050,743 | 8/1962 | Lamb | 4/502 |
| 3,070,811 | 1/1963 | Bender | 4/502 |
| 3,144,665 | 8/1964 | Meyer | 4/502 |
| 3,600,721 | 8/1971 | Pussey | 4/499 |
| 3,613,126 | 10/1971 | Granderath | 4/502 |
| 3,747,131 | 7/1973 | Koliomichalis | 4/499 |
| 3,748,664 | 7/1973 | Morita | 4/502 |
| 3,916,457 | 11/1975 | Morita | 4/502 |
| 3,940,809 | 3/1976 | Hughes | 4/499 |

FOREIGN PATENT DOCUMENTS

| | | | |
|---|---|---|---|
| 2508258 | 9/1975 | Fed. Rep. of Germany | 4/499 |

*Primary Examiner*—Henry K. Artis
*Attorney, Agent, or Firm*—David O'Reilly

[57] ABSTRACT

A floatable pool cover comprised of a generally rectangular sheet of material conforming to the surface area of a pool having substantially rigid, floatable members attached along two opposite sides of the material. The substantially rigid, floatable members are approximately equal in length to the opposite ends of the pool, allowing the cover to be stretched across the pool and laid on the surface of the water. The rigid, floatable members will keep the cover floating on top of the pool. The pool cover may be easily removed by rolling it up and equally as easily replaced by simply unrolling it.

33 Claims, 10 Drawing Figures

FLOATABLE POOL COVER

BACKGROUND

The purpose of the present invention is to provide a floatable pool cover which is easy and simple to remove and replace.

Numerous types of pool covers are provided to keep the pool water clean, as well as to prevent evaporation and loss of heat. Some of these covers are in the form of heavy plastic sheets stretched across the pool and overlapping the edges with water bags, weights or sand bags holding the cover in place. Obviously, such an arrangement is difficult and time-consuming to put in place and equally as difficult to remove.

Another type of cover is comprised of a plastic sheet having a cellular composition which will simply float on top of the water. A disadvantage of this type of cover is that it is difficult to put in place. Usually, it requires two persons to install with one at each corner dragging the sheet material along either side of the pool, stretching it out. To remove it, it again requires two people to fold it up as it is removed.

Still another type of cover, provides a floatable member around the entire peripheral edge of the cover. Obviously, if the floatable member is not soft and easily crushed or folded, this type of cover would be almost impossible to remove. Again, it requires more than one person to fold the cover up for removal or stretch it out for placement on top of the surface of the pool, and could not be rolled up on reel.

OBJECTS AND SUMMARY

The purpose of the present invention is to provide a pool cover which is simple and easy to put in place and equally simple to remove.

The purposes of the present invention are accomplished by providing a rectangular, flexible sheet having rigid floatable members along two opposite edges of the sheet. This allows the cover to be easily rolled up for removal or to be unrolled and stretched out for placement on top of the surface of the water of the pool. The rigid floatable members prevent the plastic cover from turning up at the corners when in place on top of the water. Further, because the floatable members are substantially rigid, one person can stretch the cover out evenly.

In order to prevent the cover from floating toward the center of the pool, tie lines are attached to the rigid floatable members which can be secured at each end or side of the pool to hold the cover in place.

In order to simplify removal of the cover, a reel, spool or rotatable drum will be mounted at one end of the pool onto which the pool cover can be rolled. The reel is rotably mounted in supports and has means for securing one of the rigid rods to the drum. The securing means is in the form of a self-aligning device. As the reel is rotated with a crank or by some suitable motorized means, the self-alignment device aligns the rigid floatable member attached to one end of the plastic sheet with the axis of the drum. Therefore, the substantially rectangular cover is automatically wound or rolled up evenly on the reel. A tie line, or pull string, attached near the center of the other floatable member, allows the pool cover to be easily unwound from the drum. As was indicated above, one person can stretch the cover out evenly as the rigid member when held or pulled at the center will pull the entire edge equally.

To put the pool cover in place, the tie line attached to the center of the floatable rigid member, is pulled on, which unwinds the pool cover from the drum in a manner similar to unwinding a window shade. When the pool cover is completely stretched over the surface of the water, the pull string or tie string is secured with the means attaching the other floatable member to the drum holding that end in place.

It is one object of the present invention to provide a floatable pool cover which may be easily placed on the surface of the pool and, just as easily, removed.

Another object of the present invention is to provide a floatable pool cover comprised of a flexible sheet having rigid portable members attached along two opposite edges.

Still another object of the present invention is to provide a floatable pool cover having means for easily rolling up the cover to remove it from the pool surface.

Yet another object of the present invention is to provide a floatable pool cover in which the means for easily rolling up the cover has self-aligning means.

These and other objects of the invention become apparent from the following detailed description of the invention, when considered in conjunction with accompanying drawings wherein like reference numbers identify like parts throughout.

DESCRIPTION OF THE PREFERRED EMBODIMENT

Figure 1:
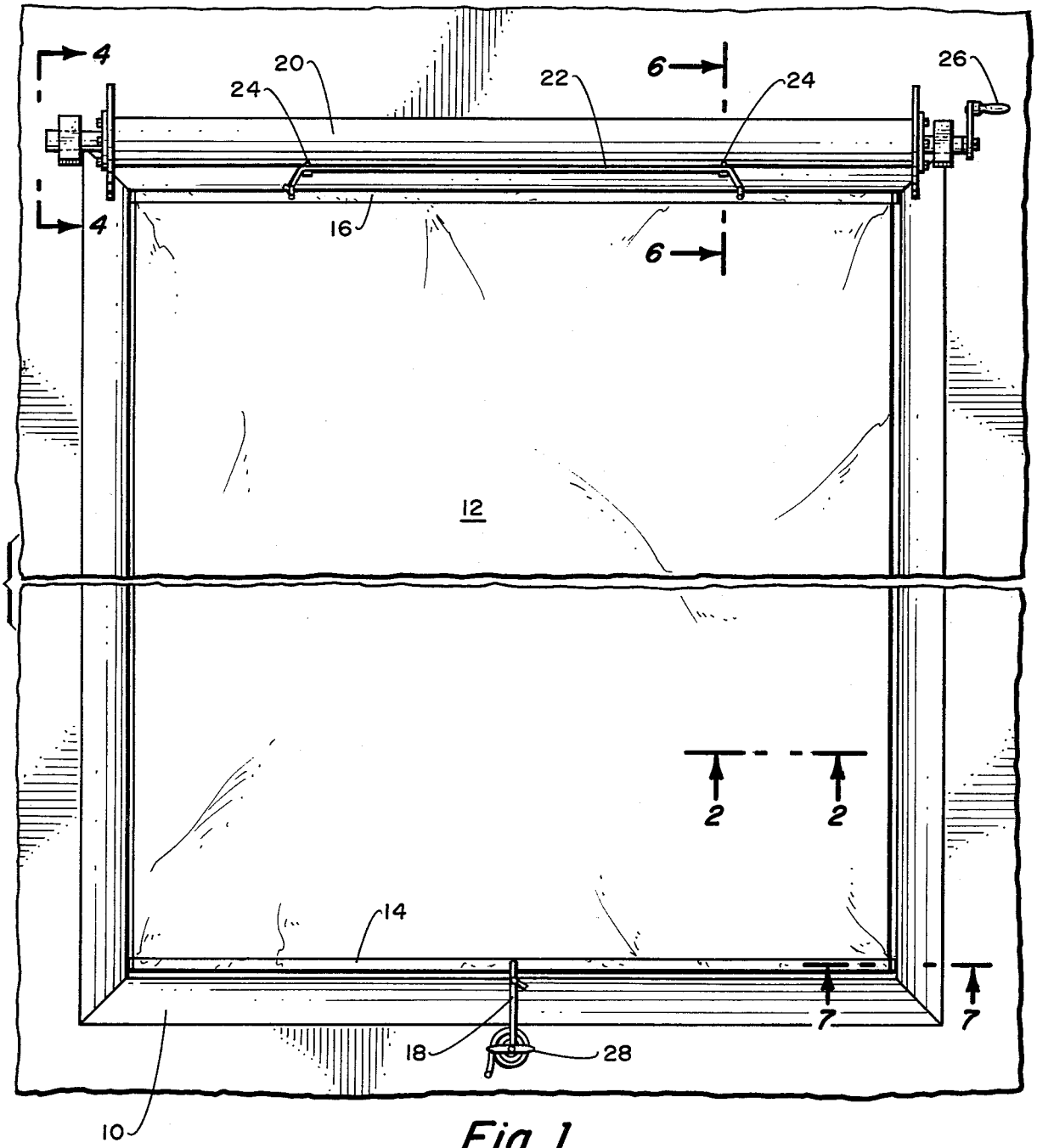
FIG. 1 is a top view of a pool having the floatable pool cover of the present invention.

The floatable pool cover of the present invention is generally most suitable for rectangular pools, as illustrated in FIG. 1. While the cover may be used on irregular-shaped pools, it generally would not provide the complete coverage required. Thus, it is illustrated in FIG. 1, as a generally rectangular-shaped pool indicated by the border 10 having thereon a cover comprised of a flexible sheet 12. The flexible sheet 12 is floated on the surface of the water in the pool 10 and held in place by rigid floatable members 14 and 16 attached to opposite ends of the flexible plastic sheet 12. The rigid floatable members 14 and 16 may be secured by wrapping the flexible plastic sheet around the members and sewing, bonding, or in any suitable manner, attaching it to the floatable members 14 and 16. Because the floatable 14 and 16 are rigid, the pool cover may be easily stretched across the pool, much in the manner that a window shade is pulled by means of a pull or tie line 18 attached to the floatable rigid member 14, approximately at the center. The other floatable member 16 is secured to a drum 20 by means of a line 22 passing around posts 24 secured to the reel. The line 22 is then secured near the ends of the floatable member 16.

The reel 20 is rotably mounted at one end of the pool 10 for rolling up the pool cover 12. The rotable reel 20 obviously simplifies the removal of the cover 12 from the pool. However, the pool cover could also be removed by simply winding the flexible sheet 12 around one or the other of the rigid floatable members 14 or 16. The reel 20 is provided with a crank 26 for rotating it. Obviously, a motorized means could be provided for rotating the reel 20.

A unique feature of the invention is that the easy, self-aligning removal of the cover by simple untying the line 18 and rotation of the crank 26. The tie line 22 attached to the floatable member 16 is passed around and may freely slide on the posts 24 attached to the reel 20. Thus, if the floatable member 16 is not correctly aligned, the line 22 will automatically slide on the post 24 as the reel begins to turn aligning the axis of the member 16 with the axis of the reel 20. Thus, the line and post 24 cooperate to provide a self-alignment of the floatable member 16 with the reel 20 for winding the pool cover on the reel. As the crank 26 is turned, rotating the reel 20, the line pulls the floatable member 16 and flexible cover 12 onto the reel 20 winding it fully on the reel. The line 22 is preferably a heavy monofilament fiberglas line which will easily slide on posts 24. Alternatively, rollers could be mounted on the posts allowing the line 22 to easily equalize.

To replace the cover on the pool, the tie line 18 can be pulled by one person at the other end of the pool, pulling the rigid floatable member 14 from the drum and stretching the cover across the pool. The tie line 18 may then be secured to a clete or post 28 or any other suitable means provided at the end of the pool adjacent to the rigid portable member 14. The tie line 22 passed around posts 24 holds the rigid floatable member 16 in place at the other end of the pool.

Figure 2:
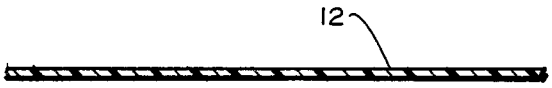
FIG. 2 is a sectional view taken at 2—2 of FIG. 1.
Figure 3:
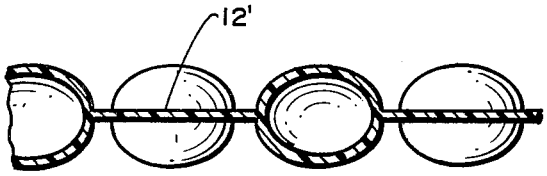
FIG. 3 is a sectional view, also taken at 2—2, indicating an alternative construction of the flexible sheet.

The flexible sheet material 12 used for the pool's cover may be any suitable flexible material. The material may be a polyethylene sheet 12, as illustrated in FIG. 2, or the cellular construction illustrated at 12' in FIG. 3. The advantage of the polyethylene sheet illustrated in FIG. 2 is that this plastic is inexpensive, thus reducing the overall cost of producing a pool cover. Also, the flat sheet will wind more compactly on the drum 20 reducing the need for storage space. In the cellular construction illustrated in FIG. 3 each of the cells is filled with air, adding to the flotation of the cover. However, a disadvantage of this material is that it is much more costly and when rolled up will require considerably more space. However, an advantage of this material is that it would reduce the heat and evaporation loss from the pool somewhat offsetting the disadvantages mentioned above.

Figure 4:
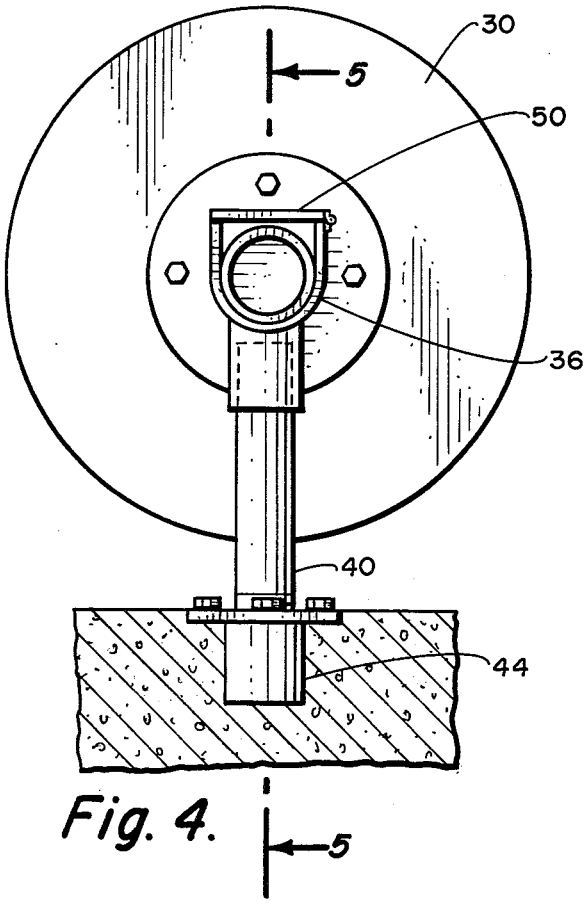
FIG. 4 is an end view taken at 4—4 of FIG. 1.
Figure 6:
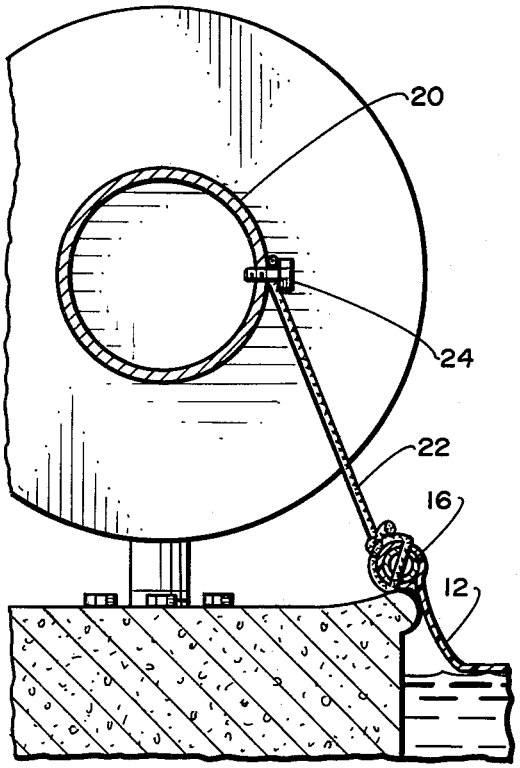
FIG. 6 is a sectional view illustrating the self-aligning device of the present invention.
Figure 5:
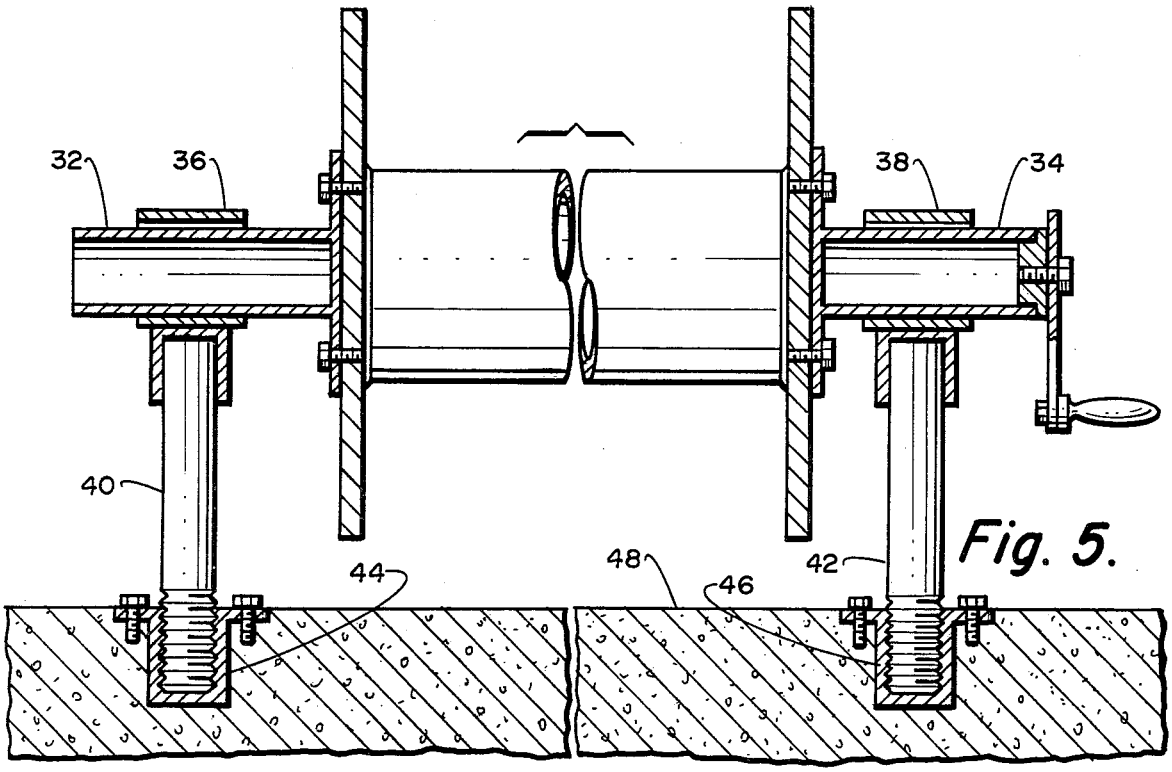
FIG. 5 is a partial sectional view illustrating the construction and mounting of the roller drum.

The construction of the roller reel and crank system is illustrated in FIGS. 4 and 5. The drum portion of the reel is constructed of a suitable lightweight galvanized sheet metal tubing, such as stove pipe, having flanges 30 attached at each end for guiding the flexible pool cover on the reel. The ends of the reel are secured to shafts 32 and 34 mounted in sockets 36 and 38 supported by upright pipes 40 and 42. The pipes 40 and 42 are threaded into sockets 44 and 46 embedded in the decking 48 around the pool. Preferably, the sockets 36 and 38 have easily removed clamp means in the form of covers or plates 50 so that the reel will not jump out of the sockets during use, but can be lifted off and removed to an area away from the pool when the pool is in use. The upright legs or stands 40 and 42 may then be removed from the sockets 44 and 46.

Figure 8:
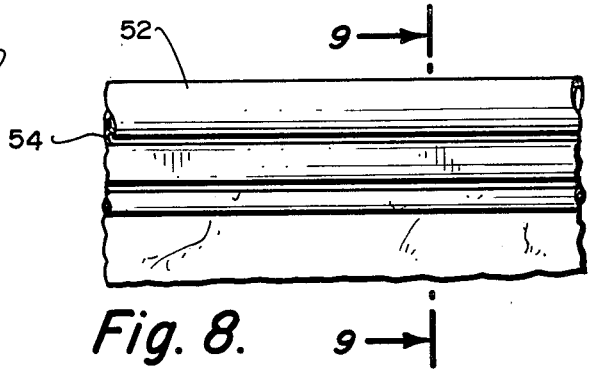
FIGS. 8, 9 and 10 illustrate an alternative construction according to the present invention.
Figure 9:
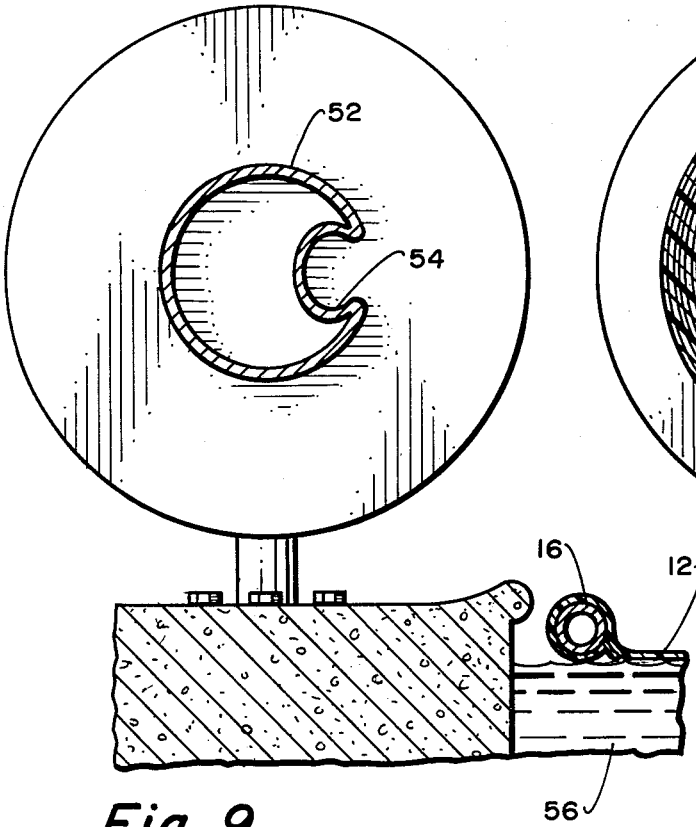
Figure 10:
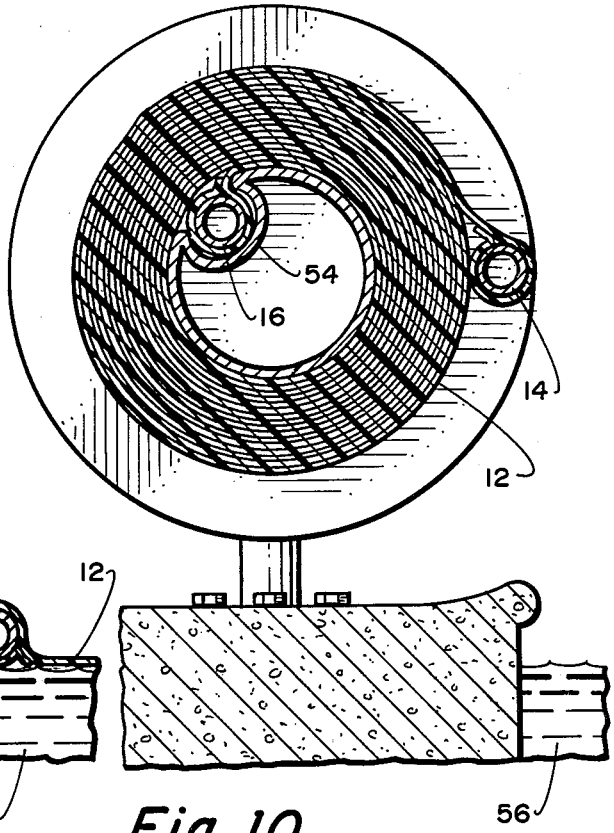

An alternative method of securing the pool cover to the reel is illustrated in FIGS. 8 through 10. The drum portion 52 will be provided with a longitudinal channel 54 slightly larger than the diameter of the rigid floatable member 16. Thus, the rigid portable member 16 can be lifted from the surface of the water 46, fitted into the longitudinal channel 54, and the cover 12 then wound on the reel.

Figure 7:
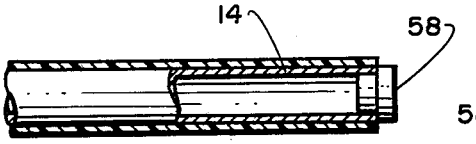
FIG. 7 is a sectional view taken at 7—7 of FIG. 1.

The rigid portable members 12, 14 may be any suitable material which is substantially rigid in construction and will float on the water. Preferably, the rigid member is a hollow rigid metal tubing as illustrated in FIG. 7. FIG. 7 shows a rigid portable member 14 constructed of a hollow metal tubing such as aluminum, stainless steel or other galvanized steel having a plug 58 in each end making the tube floatable. A wooden floatable member would be suitable, but is less desirable because it would tend to become water-logged and would lose its buoyancy after long periods of use. Additionally, heavy plastic piping might be suitable, but it is less desirable because they are somewhat flexible and may not evenly pull the flexible sheet material 12 from the reel when stretching it across the surface of a pool.

Thus, there has been described a novel method and construction of forming a pool cover which is easy to put in place and equally as easy to remove. The cover may be constructed of any suitable plastic material using rigid portable members at each end to form the floatable pool cover design. The unique construction of the invention will allow one person in a very short time to remove or replace the cover. The cover eliminates the difficulty of awkward, cumbersome construction of previous pool covers. The cover is easily rolled up onto a reel on a stand at the end of the pool. Without the reel or drum-type device, the cover is more difficult to remove but is still more desirable because it's much easier to replace and keep in place on top of the pool. Another advantage of the present invention is that the cover need not have the corners secured with sandbags or other type fastening devices, as the rigid portable members prevent the corners from turning up during rain and wind.

Obviously, many modifications and variations of the present invention are possible in light of the above teachings. It is therefore to be understood that the full scope of the invention is not limited to the details disclosed herein, but only by the claims and may be practiced otherwise than as specifically described.

What is claimed is:

1. A swimming pool cover comprising:

a generally rectangular flexible sheet having the shape of the pool to be covered;

a first substantially rigid floatable means attached to one edge of said flexible sheet and substantially the same length of said one edge of said flexible sheet;

a second substantially rigid floatable means attached to the edge of said flexible sheet generally opposite said one edge and substantially the same length as said opposite edge of said flexible sheet;

said flexible sheet and said first and second substantially rigid floatable means adapted and arranged to float on said pool when said pool is covered and to be wound on a reel when the pool is to be uncovered.

2. The pool cover according to claim 1 in which said first and second floatable means comprises aluminum tubing.

3. The pool cover according to claim 1 in which said flexible sheet comprises a flexible plastic sheet.

4. The pool cover according to claim 1 including securing means for securing said first and second floatable means at the respective ends of a pool.

5. The pool cover according to claim 1 including means for rolling said flexible sheet up; said means for rolling said flexible sheet up comprising:

reel means;

rotatable means rotatably mounting said reel means at one end of the pool;

rotating means for rotating said reel;

attachment means for attaching one edge of said flexible sheet to said reel;

whereby rotation of said reel causes said flexible sheet to be wound around said reel.

6. The pool cover according to claim 5 including self-alignment means for automatically aligning said flexible sheet with said reel when it is wound up.

7. The pool cover according to claim 6 in which said attachment means includes said self-alignment means.

8. A swimming pool cover comprising:

a generally rectangular flexible sheet having the shape of the pool to be covered;

a first substantially rigid floatable means attached to one edge of said flexible sheet;

a second substantially rigid floatable means attached to the edge of said flexible sheet generally opposite said one edge;

rotatable reel mounted at one end of said pool;

rotating means for rotating said reel;

attachment means for attaching one edge of said flexible sheet to said rotatable reel for rolling said sheet of said flexible material up;

said attachment means including self alignment means comprising;

flexible line means attached to one of said floatable means adjacent to each of its ends, a pair of spaced apart posts attached to said reel, said flexible line being passed around and slideable on said posts, whereby when said reel is rotated, said flexible line slides on said post and automatically adjusts the axis of said rigid floatable means to be parallel with the axis of said reel so that said flexible sheet is wound evenly on said reel.

9. The pool cover according to claim 8 in which said line is monofilament fiberglas line so that it easily slides on said posts.

10. The pool cover according to claim 8 including;

rotatable guides mounted on each post;

said line being passed around and mounted on said guides so that said line easily slides on said posts.

11. The pool cover according to claim 1 in which said flexible sheet material comprises a flexible polyethylene plastic sheet.

12. The pool cover according to claim 1 in which said flexible sheet is a floatable cellular sheet.

13. The pool cover according to claim 1 in which said flexible sheet has a large plurality of air-filled cells.

14. A swimming pool cover comprising:

a generally rectangular flexible sheet having the shape of the pool to be covered;

a first substantially rigid floatable means attached to one edge of said flexible sheet;

a second substantially rigid floatable means attached to the edge of said flexible sheet generally opposite said one edge;

a rotatable reel mounted at one end of said pool;

rotating means for rotating said reel;

attachment means for attaching one edge of said flexible sheet to said rotatable reel for rolling said sheet of said flexible material up;

said attachment means including self alignment means comprising;

a longitudinal groove in said drum, said longitudinal groove adapted to receive one of said floatable means, whereby said one floatable means may be lifted and fitted into said groove for winding said flexible sheet onto said reel.

15. A swimming pool cover comprising:

a generally rectangular flexible sheet having the shape of the pool to be covered;

a first substantially rigid floatable means attached to one edge of said flexible sheet;

a second substantially rigid floatable means attached to the edge of said flexible sheet generally opposite said one edge;

a rotatable reel mounted at one end of said pool;

rotating means for rotating said reel;

attachment means for attaching one edge of said flexible sheet to said rotatable reel for rolling said sheet of said flexible material up;

said attachment means comprising;

a longitudinal groove in said drum, said longitudinal groove adapted to receive one of said floatable means, whereby said one floatable means may be lifted and fitted into said groove for winding said flexible sheet on said reel.

16. The pool cover according to claim 14 or 15 including securing means for securing the other of said floatable means when said pool cover is in place on said pool.

17. The pool cover according to claim 16 in which said securing means comprises a line attached to said floatable means near the center whereby said line can be used to pull and unwind said cover from said reel and tie down said floatable means at the end of the pool.

18. The pool cover according to claim 8 including securing means for securing the other of said floatable means when said pool cover is in place on said pool.

19. The pool cover according to claim 18 in which said securing comprises a line attached to said floatable means near the center whereby said line can be used to pull and unwind said cover from said drum and tie down said floatable means near the end of the pool.

20. The pool cover according to claim 19 including mounting means for removably mounting said socket means whereby said reel and socket means may be moved away from said pool during use.

21. The pool cover according to claim 20 in which said mounting means comprises;

threaded pipe socket means embedded in the pool decking near adjacent corners;

said shaft socket means being attached to the opposite end of said pipe means.

22. The pool cover according to claim 21 including clamp means on said shaft socket means for locking said reel to said sockets.

23. A swimming pool cover comprising:

a generally rectangular flexible sheet having the shape of the pool to be covered;

a first substantially rigid floatable means attached to one edge of said flexible sheet;

a second substantially rigid floatable means attached to the edge of said flexible sheet generally opposite said one edge;

a rotatable reel mounted at one end of said pool;

rotating means for rotating said reel;

attachment means for attaching one edge of said flexible sheet to said rotatable reel for rolling said sheet of said flexible material up;

rotatable means for rotatably mounting said reel comprising;

shaft means attached at each end of said reel, shaft socket means mounted near adjacent corners of said pool, said shaft means rotatably seating in said socket means.

24. The pool cover according to claim 7 in which said self-alignment means comprises;

flexible line means attached to one of said floatable means adjacent to each end;

a pair of spaced apart posts attached to said reel;

said flexible line being passed around and slidable on said posts;

whereby when said reel is rotated, said flexible line slides on said posts and automatically adjusts the axis of said rigid floatable means to be parallel with the axis of said reel so that said flexible sheet is wound evenly on said reel.

25. The pool cover according to claim 24 in which said line is monofilament fiberglas line so that it easily slides on said posts.

26. The pool cover according to claim 24 including;

rotatable guides mounted on each post;

said line being passed around and mounted on said guides so that said line easily slides on said posts.

27. The pool cover according to claim 5 in which said attachment means comprises;

a longitudinal groove in said drum;

said longitudinal groove adapted to receive one of said floatable means;

whereby said one floatable means may be lifted and fitted into said groove for winding said flexible sheet onto said drum.

28. The pool cover according to claim 27 including securing means for securing the other of said floatable means when said pool cover is in place on said pool.

29. The pool cover according to claim 27 in which said securing means comprises a line attached to said floatable means near the center whereby said line can be used to pull and unwind said cover from said reel and tie down said floatable means at the end of the pool.

30. The pool cover according to claim 5 in which said rotatable means for rotatably mounting said reel comprises;

shaft means attached at each end of said reel;

shaft socket means mounted near adjacent corners of said pool;

said shaft means rotatably seating in said socket means.

31. The pool cover according to claim 30 including mounting means for removably mounting said socket means whereby said reel and socket means may be moved away from said pool during use.

32. The pool cover according to claim 31 in which said mounting means comprises;

threaded pipe socket means embedded in the pool decking near adjacent corners;

said shaft socket means being attached to the opposite end of said pipe means.

33. The pool cover according to claim 32 including clamp means on said shaft socket means for locking said reel to said sockets.

* * * * *